US005413165A

United States Patent [19]

Wylie

[11] Patent Number: 5,413,165

[45] Date of Patent: May 9, 1995

[54] TEMPERATURE CONTROL SYSTEM FOR MULTI-STORY BUILDING

[75] Inventor: Calvin R. Wylie, Fair Oaks, Calif.

[73] Assignee: Beutler Heating and Air Conditioning, Inc., Sacramento, Calif.

[21] Appl. No.: 130,883

[22] Filed: Oct. 4, 1993

[51] Int. Cl.[6] ..... F24F 13/04

[52] U.S. Cl. ..... 165/22; 62/186; 165/30; 165/39; 236/1 B

[58] Field of Search ..... 165/14, 16, 22, 25, 165/26, 27, 30, 39; 62/186; 236/1 B, 1 C, 13

[56] References Cited

U.S. PATENT DOCUMENTS

| | | | |
|---|---|---|---|
| 4,009,825 | 3/1977 | Coon | 165/22 |
| 4,210,278 | 7/1980 | Obler | 165/16 |
| 4,324,288 | 4/1982 | Karns | 165/22 |
| 4,397,157 | 8/1983 | Keuch | 165/16 |
| 4,673,029 | 6/1987 | Beachboard | 165/22 |
| 4,676,073 | 6/1987 | Lawrence | 165/16 |
| 4,830,095 | 5/1989 | Friend | 165/22 |
| 4,915,294 | 4/1990 | Wylie . | |
| 4,993,629 | 2/1991 | Wylie . | |

*Primary Examiner*—Ira S. Lazarus
*Assistant Examiner*—Daniel J. O'Connor
*Attorney, Agent, or Firm*—Thomas R. Lampe

[57] ABSTRACT

Apparatus for heating or cooling the levels of a multi-story building. A single furnace-air conditioning unit is utilized to heat or cool the levels as dictated by the settings of thermostats in each level. An arrangement is employed to direct heated air from the upper level to the lower level during the heating cycle to lessen temperature differentials between the upper and lower levels.

9 Claims, 2 Drawing Sheets

TEMPERATURE CONTROL SYSTEM FOR MULTI-STORY BUILDING

TECHNICAL FIELD

This invention relates to an apparatus for modifying the temperatures of interiors of a multi-story building. In particular, the arrangement disclosed herein provides independent control of both heating and cooling at the floors of a multi-story building.

BACKGROUND ART

It is known in the art of building structure heating to propel air, as by means of a fan, from a lower level to an upper level. Often systems of this nature are deficient in that they require either continuous fan operation, which itself utilizes excess amounts of energy, or constant manual intervention, which is both inefficient and time consuming.

The invention disclosed in my U.S. Pat. No. 4,915,294, issued Apr. 10, 1990, relates to a system which operates automatically to lessen the differential of temperatures in upper and lower building level interiors. The system operates by redistributing the hot air which normally rises to the upper levels of a multi-story building to a lower level, thereby providing a more uniform temperature throughout the building.

My U.S. Pat. No. 4,993,629, issued Feb. 19, 1991, is, in essence, an improvement of the system disclosed in my U.S. Pat. No. 4,915,294. In common therewith, the invention of U.S. Pat. No. 4,993,629 incorporates structure which is operable to automatically initiate an air flow from an upper level interior to a lower level interior when temperatures sensed by sensors in the interiors differ to a predetermined extent. The arrangement of the latter patent, however, differs from the earlier invention in that it incorporates heat generating means and controls the operation of the heat generating means to heat the air delivered to the lower level interior after the temperature differential between the upper level and the lower level interiors has reached a predetermined level below the temperature differential required to initiate air flow between the upper and lower interiors. In other words, with the system of U.S. Pat. No. 4,993,629, the burner of a furnace or other heat generating means is not actuated until efficient use is made of the heated air in an upper level interior to heat the lower level interior.

DISCLOSURE OF INVENTION

In common with the systems disclosed in the above-referenced patents, the system disclosed herein incorporates a feature which lessens the problems caused by heat stratification in a multi-story building such as a two-story home. This is accomplished without the necessity of employing external sensors of the type disclosed in my U.S. Pat. No. 4,993,629.

The present system is controlled by thermostats placed at each floor level to correct the heat stratification problem by directing hot air from the hotter upper floor to the cooler lower floor, thus making efficient use of the furnace. Since external sensors at the floor levels are not employed with the present system, the system is simplified with the cost for the sensors, wiring, and additional labor required to install them eliminated altogether.

The system of the present invention also allows both heating and cooling to be independently controlled by thermostats placed at the upper and lower levels of the building. It allows for separate temperature set points at each floor, thereby providing substantial energy savings by heating or cooling only the floor being serviced at that time. The system actually provides the advantages of two separate heating-air conditioning systems without the capital and installation costs associated with such arrangements.

The apparatus of the present invention is for use in a building having upper and lower levels, each level including a floor, a ceiling, and walls between the floor and ceiling defining an interior. The apparatus can be utilized to raise or lower the temperatures of each of the interiors.

The apparatus includes air delivery means, heat generating means, and cold generating means.

First duct means provides air flow communication between the air delivery means and the upper and lower levels. The first duct means includes two ducts, one of the ducts having an outlet in communication with the lower level interior and the other of the ducts having an outlet in communication with the upper level interior.

Damper means is operatively associated with the first duct means and includes a damper in operatively association with each of the ducts to independently control the movement of air in each of the ducts.

A thermostat is located in each of the interiors. Control means is in operative association with the air delivery means, the heat generating means, the cold generating means, and the damper means for selectively alternatively activating the heat generating means and the cold generating means and selectively directing heat from the heat generating means and cold from the cold generating means by selectively actuating the air delivery means to cause air to flow alternatively past either the heat generating means or the cold generating means to create a flow of either heated air or cold air in the duct means. The control means controls positioning of the dampers relative to both of the ducts to regulate and control flow of either heated or cooled air in the ducts responsive to settings of the thermostats.

The thermostats are independently operable to call for either heated air or cooled air through the duct means. The control means is cooperable with the heat generating means and the cold generating means to actuate the heat generating means prior to actuating the cold generating means when one of the thermostats is calling for heated air and the other of the thermostats is calling for cooled air.

The apparatus additionally comprises a second duct means providing air flow communication between the upper level interior and the air delivery means for directing air from the upper level interior through the first duct means to the lower level interior.

The control means includes first timer means for limiting the period of time the heat generating means is activated to a predetermined duration as well as second timer means being responsive to deactivation of the heat generating means by the first timer means after the predetermined duration to operate the air delivery means to direct air from the upper level interior to the lower level interior through the first duct means and the second duct means for a predetermined period of time.

Other features, advantages, and objects of the present invention will become apparent with reference to the following detailed description and accompanying drawings.

BEST MODE FOR CARRYING OUT THE INVENTION

Figure 1:
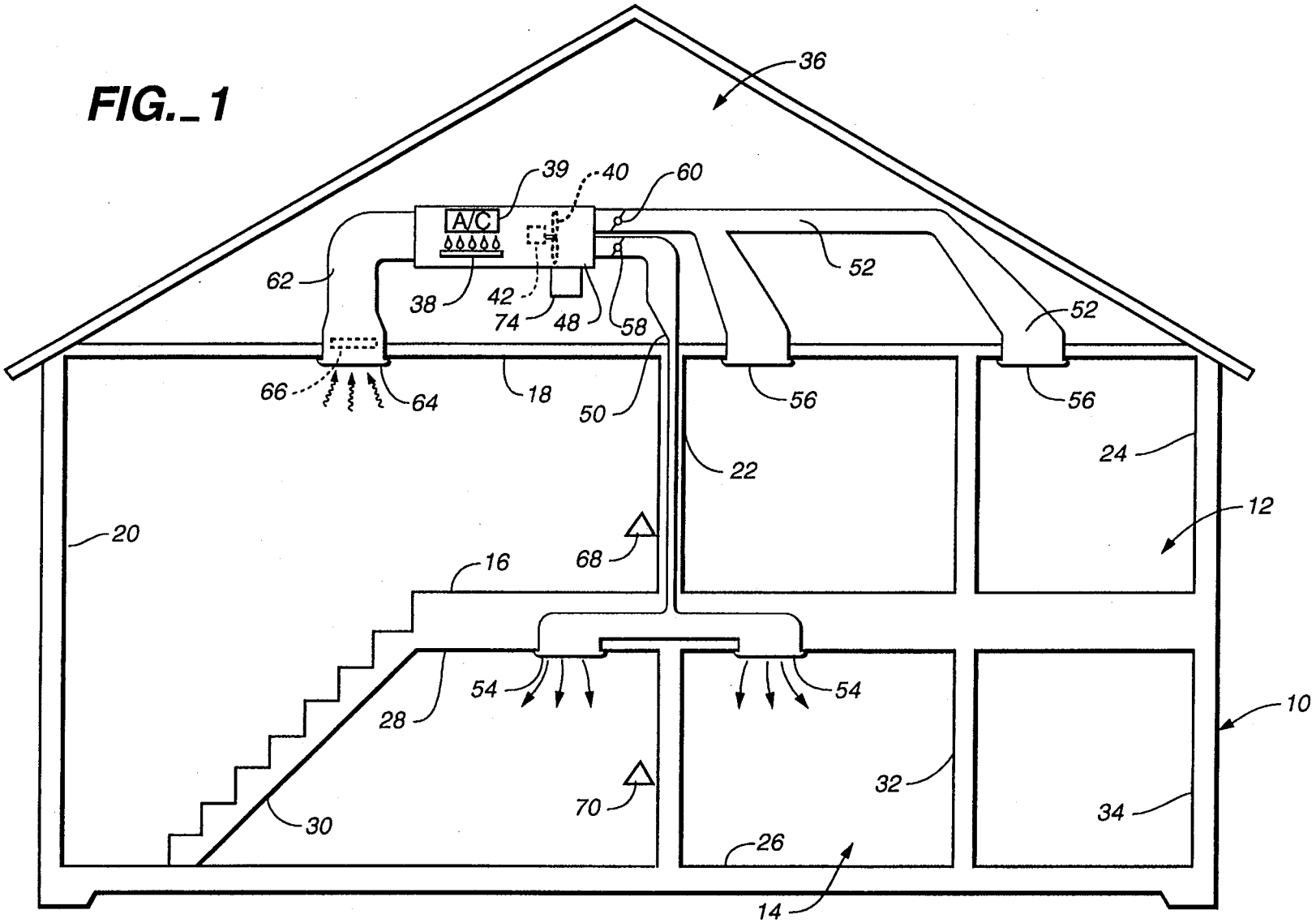
FIG. 1 is a diagrammatic, side view of the inside of a multi-level building incorporating apparatus constructed in accordance with the teachings of the present invention.

Referring now to the drawings, a multi-story or multi-level building 10, which may be of any suitable construction, is illustrated. Building 10 includes an upper level 12 and a lower level 14. Upper level 12 includes, as is conventional, a floor 16, a ceiling 18, and walls, such as walls 20, 22 and 24, between the floor and ceiling to define an interior.

Similarly, lower level 14 includes a floor 26, a ceiling 28, and walls, such as walls 30, 32 and 34, which define a lower level interior.

The illustrated building 10 also includes an attic 36 above ceiling 18. Positioned in the attic is a heating-/cooling device of conventional construction including a furnace 38 and an air conditioner 39. Alternatively, the air conditioner and furnace could be separate as well as located at different positions relative to the building, for example, outside adjacent to the building. The combined air conditioner/furnace illustrated is operatively associated with air delivery means in the form of a fan 40 and a motor 42 of any suitable conventional type for rotating the fan 40 when energized.

The illustrated heat generating means of the furnace 38 is a gas jet assembly selectively communicable with a suitable source of gas (not shown). It is to be understood, however, that the heat generating means may be in the form of electrical coils or any other suitable conventional heat generation apparatus.

A plenum 48 is located at the end of the furnace/air conditioner device. Leading from plenum 48 is first duct means including two discrete ducts 50 and 52. Duct 50 has two outlets 54 in communication with the interior of lower level 14. Duct 52 has two outlets 56 in communication with the interior of upper level 12.

A damper 58 is disposed in duct 50 and a damper 60 is disposed in duct 52. The dampers may be of any suitable type, such as round motorized dampers well known in the building heating and cooling art. The ducts 50, 52 must be sized to handle additional air volume when either damper has been closed. For optimum operation of the system and user comfort, it is recommended that the duct system serving each level be sized to handle 75 per cent of the total system air flow.

Second duct means in the form of duct 62 provides air flow communication between the interior of upper level 12 and the air delivery means including fan 40 and motor 42. Duct 62 has an inlet 64 located at ceiling 18 of upper level 12. Optionally, an air filter 66 may be disposed in duct 62.

A thermostat 68 is located in the interior of upper level 12 and a second thermostat 70 is located in lower level 14. That is, each floor has its own thermostat for controlling either the heating or cooling of the floor. The thermostats are operated by the user in the same manner as a standard heating/cooling system thermostat. The user will select either HEAT or COOL at the thermostat selector switch, and set the thermostat set point at the desired setting. The thermostat at each floor can independently operate the furnace/air conditioner system, turning on the unit in the selected mode, as well as opening the motorized damper on the duct trunk line serving that particular floor. It is recommended that the user set both thermostats in the same mode, either both HEAT or both COOL, but the arrangement of the present invention is designed to prevent the system from operating in both the heating and cooling capacity at the same time, in case the situation should occur, either intentionally, or accidentally.

Figure 2:
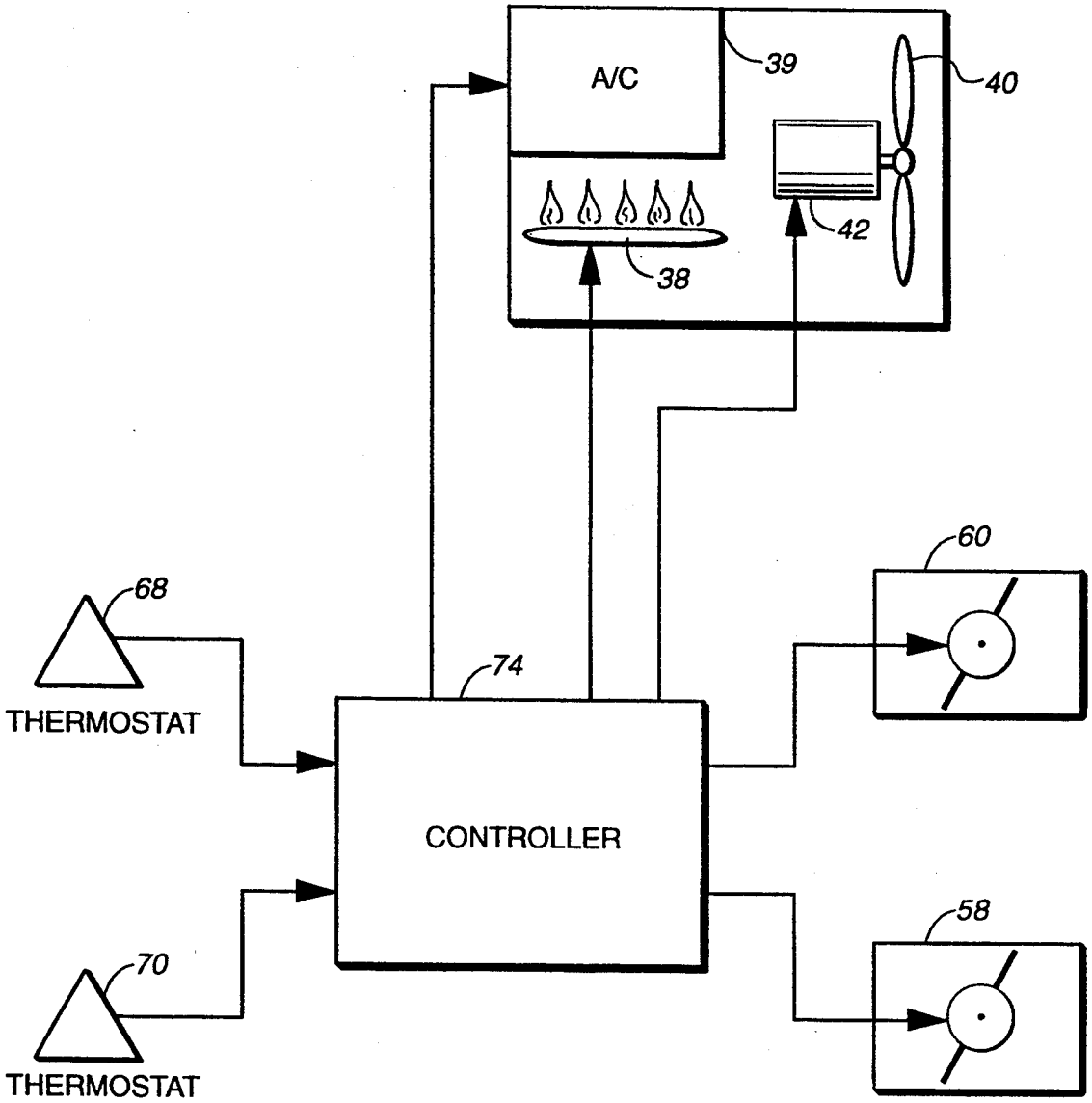
FIG. 2 is a schematic presentation of the selected components of the apparatus and illustrating the cooperative relationship existing therebetween.

Located at a suitable location within building 10 is a controller 74. In the arrangement shown in FIG. 1, controller 74 is connected to the furnace/air conditioner, but it is to be understood that the controller may be placed at any other reasonably accessible area. The controller 74 is in the form of a microprocessor suitably programmed to perform the functions desired. As shown in FIG. 2, the controller 74 is wired to the thermostats 68, 70 to receive the inputs thereof. Outputs from the controller 74 are directed to furnace 38, the air conditioner 39, and the motor 42 driving fan 40. Additionally, dampers 58, 60 are hard wired to the controller and opening or closing thereof controlled by the controller.

Operation of the system will now be described. When second floor thermostat 68 is set to the HEAT position, and the temperature on that floor drops below the set point (i.e. 70 degrees), the thermostat will signal the controller 74, which in turn will activate the furnace and close the damper 58 feeding the lower or first floor registers, unless the thermostat 70 is also calling for heat. Dampers 58, 60 are of the motorized type, power closed and spring opened, so the damper 60 will be open at the time of this procedure. Should the furnace already be operating due to a "call" from the lower floor thermostat 70, the only action prompted by a call from the thermostat 68 will be opening of the upper floor damper 60.

When the second floor thermostat is set to the COOL position, and the second or upper floor temperature rises above the set point, the thermostat 68 will signal the controller 74, which in turn will activate the fan 40 and the condenser section of the air conditioner 39, as well as close the lower floor damper 58.

When the lower or first floor thermostat 70 calls for heat, the controller 74 will turn on the furnace 38 and close down the damper 60 feeding the upper floor duct work, unless it also is calling for heat. Simultaneously, an adjustable timer (10–20 minute range preferred) in the controller 74 will be activated, which limits the time that the furnace can operate in the lower floor heating mode. At the end of this time frame or the termination of the heating call from the lower floor thermostat 70 (whichever occurs first), a second timer in the controller is activated.

This second timer is the "equalizer" timer, and is, for example, adjustable in the range of zero to 10 minutes. During this cycle the controller 74 deactivates the furnace. However, the fan 40 is activated and the upper floor damper 60 is closed off. This allows for the rapid recovery of the overheated air at the upper floor level to the lower floor level, via duct 62 and duct 50.

At the end of this "equalizer" timer cycle, the heating of the lower floor by the furnace will be re-initiated, should the lower floor thermostat 70 still be calling for heat. This "equalizer" cycle, just described, will be overridden if a call for heat is received from the controller 74 via the upper level thermostat 68, or if the call for heat from the lower level thermostat 70 terminates in under three minutes. Cooling of the lower level is identical to the cooling operation of the upper floor or level.

It is preferred that the controller 74 also be suitably programmed to allow independent fan-only operation for each floor. That is, when an occupant selects a "FAN/ON" position on the zone thermostat, the fan 40 will be operated and the damper feeding the other zone or level will be closed off, thereby providing fan operation only in the desired zone. Should the other level thermostat similarly be calling for fan operation, the damper relating thereto will be opened again. This feature will be overridden by any call for heating or cooling from either zone, until that call is satisfied.

When both thermostats 68 and 70 are in the same heating or cooling operation mode (HEAT or COOL), the first floor to call will energize the furnace-air conditioner unit and close down the damper for the other level. The subsequent floor to call will then only reopen the damper for that floor level since the heating-/cooling unit is already operating. Should the first thermostat be satisfied before the second thermostat, however, then the second thermostat will keep the system energized until it too is satisfied and will close down the damper to the other zone or level.

Normally, the thermostats on each floor will be set to the same operating mode in order to prevent "fighting" between the zones. This is especially possible when the thermostat for the lower level is set to heating and the upper thermostat is set to the cooling mode. Under these conditions, the lower floor heat lost to the upper floor would tend to cause the second floor to call for cooling, thereby wasting energy. The invention disclosed herein, as mentioned above, minimizes the problem caused by heat stratification, thereby making it unnecessary to set the thermostats in this manner.

However, should there ever be a reason for desiring cooling on one floor while the other floor needs heating, as for example when a large number of people are gathered or electrical equipment on one floor requires cooling while the outdoor temperature is still cool, the present system is designed to allow for the sequential operation of HEAT and COOL on the separate floors.

Under these circumstances, a HEAT call always has precedence over a COOL call, and a HEAT call will lock out the COOL call from the other level until the HEAT call is satisfied. Therefore, should one level require heating at the same time the other level requires cooling, the heating will be supplied to the appropriate zone first, and then cooling will be effected for the opposing zone. Therefore, each zone has a capability of receiving either heating or cooling at any time, with only an occasional slight delay while the other zone receives the opposite treatment.

I claim:

1. Apparatus for use in a building having upper and lower levels, each level including a floor, a ceiling, and walls between the floor and ceiling defining an interior, said apparatus adapted to raise or lower the temperatures of said interiors and comprising, in combination:

air delivery means;

heat generating means;

cold generating means;

first duct means providing air flow communication between said air delivery means and said upper and lower levels, said first duct means including two ducts, one of said ducts having an outlet in communication with said lower level interior and the other of said ducts having an outlet in communication with said upper level interior;

damper means operatively associated with said first duct means and including a damper in operative association with each of said ducts to independently control the movement of air in each of said ducts;

thermostats in each of said interiors; and control means in operative association with said air delivery means, said heat generating means, said cold generating means, and said damper means for selectively alternatively activating said heat generating means and said cold generating means and selectively directing heat from said heat generating means and cold from said cold generating means by selectively actuating said air delivery means to cause air to flow alternatively past either said heat generating means or said cold generating means to create a flow of either heated air or cold air in said duct means, and said control means controlling positioning of said dampers relative to both of said ducts to regulate and control flow of either heated or cooled air in said ducts responsive to settings of said thermostats.

2. The apparatus according to claim 1 wherein said thermostats are independently operable to call for either heated air or cooled air through said duct means, said control means cooperable with said heat generating means and said cold generating means to actuate said heat generating means prior to actuating said cold generating means when one of said thermostats is calling for heated air and the other of said thermostats is calling for cooled air.

3. The apparatus according to claim 1 additionally comprising second duct means providing air flow communication between said upper level interior and said air delivery means for directing air from said upper level interior through said first duct means to said lower level interior.

4. The apparatus according to claim 3 wherein said control means includes first timer means for limiting the period of time the heat generating means is activated to a predetermined duration.

5. The apparatus according to claim 4 wherein said control means includes second timer means, said second timer means being responsive to deactivation of said heat generating means by said first timer means after said predetermined duration to operate said air delivery means to direct air from said upper level interior to said lower level interior through said first duct means and said second duct means for a predetermined period of time.

6. The apparatus according to claim 5 wherein both said first and second timers are adjustable timers.

7. Apparatus for use in a building having upper and lower levels, each level including a floor, a ceiling, and walls between the floor and ceiling defining an interior, said apparatus adapted to modify the temperature of said interiors and comprising in combination:

air delivery means;

heat generating means;

first duct means providing air flow communication between said air delivery means and said upper and lower levels;

second duct means providing air flow communication between said upper level interior and said air delivery means;

first thermostat means at said lower level interior;

second thermostat means at said upper level interior; and control means operatively associated with said air delivery means and said heat generating means for activating said heat generating means and said air delivery means to deliver heated air from said heat generating means to said lower level interior through said first duct means for a first period of time not exceeding a predetermined duration in response to the first thermostat means and for deactivating said heat generating means and delivering heated air from said upper level interior to said lower level interior through said second duct means after deactivation of said heat generating means.

8. The apparatus according to claim 7 wherein said control means is operable to terminate the delivery of heated air from said upper level interior to said lower level interior after a predetermined period of time.

9. The apparatus according to claim 7 additionally comprising cold generating means, said control means for selectively alternatively activating said heat generating means and said cold generating means to create a flow of either heated air or cold air in said first duct means.

* * * * *